US006470814B2

(12) United States Patent
Keilmann

(10) Patent No.: US 6,470,814 B2
(45) Date of Patent: Oct. 29, 2002

(54) BLIND STITCH SEWING MECHANISM

(75) Inventor: Robert Keilmann, Bensheim (DE)

(73) Assignee: KSL Keilmann Sondermaschinenbau GmbH, Lorsch (DE)

( * ) Notice: Subject to any disclaimer, the term of this patent is extended or adjusted under 35 U.S.C. 154(b) by 0 days.

(21) Appl. No.: 09/934,216

(22) Filed: Aug. 21, 2001

(65) Prior Publication Data

US 2002/0035955 A1 Mar. 28, 2002

(51) Int. Cl.[7] ..... D05B 1/24; D05B 55/08

(52) U.S. Cl. ..... 112/176

(58) Field of Search ..... 112/176, 177, 112/162, 35, 175.24, 198, 470.12, 470.13

(56) References Cited

U.S. PATENT DOCUMENTS 1,322,510 A * 11/1919 Arbetter ..... 112/177
2,687,103 A * 8/1954 Mosberg ..... 112/176
4,712,495 A * 12/1987 Jagielski ..... 112/176
5,253,600 A * 10/1993 Sugahara ..... 112/177

* cited by examiner

*Primary Examiner*—Ismael Izaguirre
(74) *Attorney, Agent, or Firm*—McCormick, Paulding & Huber LLP

(57) ABSTRACT

A blind stitch sewing mechanism includes a sewing head (10) with a carrier (20), a needle shaft (34) rotatably supported on the carrier (20), which needle shaft is connected with a needle holder (36) radially extending from the needle shaft for holding an arc shaped needle curved about the axis (38) of the needle shaft (34), a needle drive (56, 58, 44, 42) for moving the needle (40) back and forth, a loop catcher (74) moveably supported on the carrier (20) for receiving a thread loop formed by the withdrawal of the needle from the work material, a catcher drive for moving the loop catcher (74) in timewise coordination with the movement of the needle (40), and a device (14) creating a relative movement between the sewing head (10) and the work material, the loop catcher (74) being formed for a back and forth movement perpendicular to the movement path of the needle (40) and the device (14) creating a relative movement between the sewing head (10) and the work material being so formed that the created sewn seam runs at least nearly in the direction of the movement path of the arc shaped needle (40).

20 Claims, 4 Drawing Sheets

BLIND STITCH SEWING MECHANISM

FIELD OF THE INVENTION

The invention concerns a blind stitch sewing mechanism including a sewing head with a carrier, a needle shaft rotatably supported on the carrier and connected with a needle holder radially displaced from the needle shaft for holding a needle shaped arcuately about the axis of the needle shaft, a needle drive for reciprocating the needle back and forth, a loop catcher moveably supported on the carrier for receiving a thread loop formed upon the withdrawal of the needle through the work material, a loop catcher drive for movement of the loop catcher in timewise coordination with the movement of the needle, and a means for creating a relative movement between the sewing head and the work material.

BACKGROUND OF THE INVENTION

A blind stitch sewing machine of the above named kind is for example known from DE-PS 1106153. In the solution there described the work material, with the help of a material bender arranged below the work material support surface, is locally pressed upwardly with each stitch so that a small section of the work material comes into the curved movement path of the needle. The movement path of the needle is perpendicular to the transport direction of the work material. The loop catcher must execute a relatively complex movement in order to so hold the loop stemming from the previous stitch that the needle in the immediately following stitch extends through the loop. A further disadvantage is that this blind stitch machine is only useable for relatively thin work material which is insertable between the needle and the material bender. It is therefore a prerequisite that the work material is accessible at its underside in order to provide the construction components making up the material bender.

There are workpieces which, because of their measurement and shape, can not be inserted into a blind stitch sewing machine of the previously mentioned kind. In order to be able to create sewn seams at desired spots in three dimensionally shaped workpieces independently of their size, a sewing machine is already known from DE 19751001 in which an up and down moving straight needle and an up and down moving straight line catcher in a common movement plane perpendicular to the sewing direction are inclined by a sharp angle to one another so that their movement paths intersect one another below the workpiece. The catcher grabs the loop formed upon the withdrawing of the needle below the workpiece and pulls it upwardly to the upper side of the workpiece where it positions the loop in the movement direction of the sewing machine, that is in the sewing direction. During the next oscillation the newly formed loop is pulled through this earlier loop, and so forth. The sewing head can be arranged on a robot by means of which it is guided over the work material surface. The sewing machine requires no construction components arranged below the workpiece and it is therefore useable independently of the size and shape of the workpiece. The support surface for the workpiece must of all things have a gap in the area of the seam to be formed so that the needle and catcher can penetrate through the workpiece and extend out of the underside of the workpiece.

In the manufacture of fiber reinforced composite materials fiber mats have to be sewn together before the fiber mats lying in forms are cast with plastic. In this case it is desirable that the mats not be moved again after the sewing, that is that they for example be sewn in the form. This is not possible with the sewing apparatus according to DE-PS 110653 or DE 19751011.

The invention has as its object the provision of a blind stitch sewing apparatus of the previously mentioned kind by way of which a sewn seam can be formed in workpieces of any chosen size, without the seam forming work tools having to escape from the opposite side of the workpiece or without the opposite side of the workpiece having to be accessible.

SUMMARY OF THE INVENTION

The above object is solved by the invention in that the thread catcher is supported for a back and forth movement perpendicular to the movement path of the needle and in that the means for creating the relative movement between the sewing head and a work material is so formed that the formed sewn seam runs at least nearly in the direction of the movement path of the needle.

In the inventive solution the circular arc shaped needle dips into the work material which can for example have a thickness from 10 to 15 mm. The needlepoint then again protrudes from the work material at the insertion side of the work material without the needle touching the side of the workpiece opposite to the insertion side. The work material therefore remains lying on the under support and is not lifted or deflected by a material bender or by a part moving out of its underside. The loop catcher executing a simple pivotal movement holds the loop during the reverse movement of the needle and carries it along for the distance of the stitch length, after the needle has left the work material and the sewing head moves relative to the work material. The loop catcher holds the loop until the needle point during the immediately following stitch passes through the loop.

Since the needle and loop catcher each execute only a pivotal movement about a rigidly positioned axis the construction of the inventive sewing apparatus is extraordinarily simple. Since in the inventive blind stitching sewing apparatus the side of the workpiece opposite the stitch insertion side remains undisturbed the support for the workpiece may be of any chosen shape. It is especially possible to lay mats of fiber material to be sewed into a casting form prior to the sewing, which casting form after the completion of the sewing process can then be filled with cast plastic material. In this way the sewn fiber material needed for the making of the composite material need not be moved after the sewing operation.

Preferably a work material holddown is arranged on the carrier, which holddown has a slot corresponding to the movement path of the needle, to avoid the work material being taken along with the needle during the withdrawal of the needle from the work material. To be able to regulate the penetration depth of the needle the work holddown is advantageously arranged on the carrier in such a way as to be adjustable in height.

Thanks to the simple movement executed by the loop catcher, the loop catcher can be formed as a simple thorn fastened to a pivotal lever, which lever in turn is pivotally supported on the carrier and is connected with the catcher drive.

According to a first embodiment the needle drive has a drive motor, reversible as to its direction of rotation, the output shaft of which needle drive is coupled with the needle shaft through a drive mechanism. One such reversible drive motor is for example a step motor. The drive mechanism can include a toothed belt which meshes with a toothed pulley on the output shaft of the drive motor and with a toothed pulley located on the needle shaft. This kind of drive permits a variable construction of the sewing head, since the toothed belt requires only a small amount of space and, for example, a very lean carrier can be made, at the free end of which the needle and the loop catcher are arranged, in order to be able to sew even in narrow deeply lying hollow spaces.

In another embodiment of the invention the needle drive has a continuously rotating motor which drives a toothed segment pivotally supported on the carrier through an eccentric or crank drive, which toothed segment meshes with a gear arranged on the needle shaft. The toothed segment is reciprocated back and forth by the eccentric drive and in keeping with this likewise moves the needle shaft and the needle back and forth.

The catcher drive is advantageously controlled a cam disk or plate, for example located on the eccentric shaft. This offers the possibility of shaping the movement of the loop catcher in any desired way within a stitch cycle, while the needle movement in generally so occurs that the needle requires the same amount of time for each forward and reverse movement of the needle in the work material. However, the loop catcher can also be directly driven by means of a reversible drive motor.

The advantages of the inventive sewing apparatus especially come to light if the sewing head is arranged on a robot which moves the sewing head over very large workpiece surfaces in accordance with a pre-given program. Such a robot has to be built relatively massively in order to be able to precisely move the sewing head. Since it is difficult at high sewing speeds to stop the robot and start it again with each stitch, and the sewing head may not be moved relative to the workpiece at least so long as the needle is stuck entirely in the workpiece, it is advantageous to move the robot continuously and to support the carrier in a frame of the sewing head so as to be translatorially adjustable, so that it can be moved back and forth parallel to the relative movement of the sewing head and the work material. Similarly to the known needle transport of a sewing machine in which the needle is moved along with the workpiece for so long as it inserted into the workpiece, in this case the carrier remains unmovable relative to the workpiece for so long as the needle resides in the workpiece while the frame of the robot is continuously moved forwardly in the sewing direction. Because of the fact that the movement path of the sewing head is parallel to the movement path of the needle the carrier can also be moved earlier relative to the workpiece after the needle point during the withdrawal of the needle from the workpiece has passed beyond the deepest point of the needle path inside of the work material. This holds true at least if the workpiece itself is sufficiently flexible.

The thread loop formed at the needlepoint upon withdrawal of the needle is relatively small. To assure that the loop catcher reliably attaches to the loop it must be guaranteed that the needle independently of the forces exerted by the workpiece onto the needle constantly takes on the same position relative to the loop catcher. For this reason it is proposed according with the invention that above the workpiece holddown a guide is arranged for an extent of the needle in the neighborhood of the needle point, which guide after the insertion of the needle into the workpiece secures the later escaping forward needle area against a lateral deflection. Preferably this guide is formed as a circular groove in a roll, so that the needle is secured against lateral deflection by the walls of the groove.

Further problems can arise with very rigid or hard workpieces. If the needle point encounters such a hard or tough material there exist a danger that the needle will be heavily bent, by the high resistance at the point, between the point and the end of the needle opposite to the point, that is will be deflated outwardly from its circular arc shaped curvature. This stress increases the danger of a needle breakage. For this reason it is proposed according to the invention that the arcuately curved needle has associated with it a needle support which supports the needle at its convex outer side along at least a portion of the needle movement. Thereby an outward bending of the needle and associated material fatigue is avoided. The needle support can be formed in a simple way on a roll which is rotatably supported for movement about an axis parallel to the curvature axis of the needle and which has a circumferential groove for receiving the needle, so that the needle is guided nearly friction free on the roll and at the same time is supported by the roll.

To be able one hand to support a middle area between the needle point and the end held by the needle holder, and on the other hand to not hinder the pivotal movement of the needle, it is advantageous if the roll is adjustable between a supporting position in which it lies against the needle and an alternative position at which it has a spacing from the needle and does not hinder the pivotal movement of the needle holder. The adjustment of the roll can take place in a simple way in that it is arranged on a pivotal lever coupled with the sewing machine drive so that it is pivotal in timewise coordination with the needle movement between a first position corresponding to the supporting position of the roll and a position corresponding to the alternate position of the roll.

Whenever a sewn seam section is finished and the sewing head is to be moved relative to the work material for the beginning of a new seam, the thread or threads have to be cut. For this different thread cutters are known. The arrangement of a thread cutter near the needle movement path is however associated with great difficulties because of space problems. According to the invention this problem is solved in an especially space saving way in that the work material holddown has a foot plate for engaging the work material in which foot plate a slot for the needle is formed so that at least one of the slot longitudinal edges is formed as a first cutting edge, in that a counter knife is arranged parallel to and above the foot plate with a second cutting edge, and in that the foot plate and the counter knife are movable relative to one another parallel to the upper surface of the foot plate. This allows the thread to be cut very close to the seam end. Preferably the foot plate and the counter knife are pivotal relative to one another about an axis perpendicular to the upper surface of the foot plate. If the cutting edge of the counter knife is positioned close to the one longitudinal edge of the slot for the passage of the needle and the oppositely lying edge of the slot forms the other cutting edge a very small pivotal movement is sufficient to bring the cutting edges along their entire length into engagement with one another since the slot is relatively small. In the case of this embodiment the counter knife or the foot plate is fastened in a tube while the other part (foot plate, counter knife) is fastened to a rod extending through the tube, which rod is coupled with a pivotal drive.

BRIEF DESCRIPTION OF DRAWINGS

Further features and advantages of the invention will be apparent from the following description, which in combination with the drawings explain the invention by way of exemplary embodiments. The drawings are.

DETAILED DESCRIPTION OF THE PREFERRED EMBODIMENTS

Figure 1:
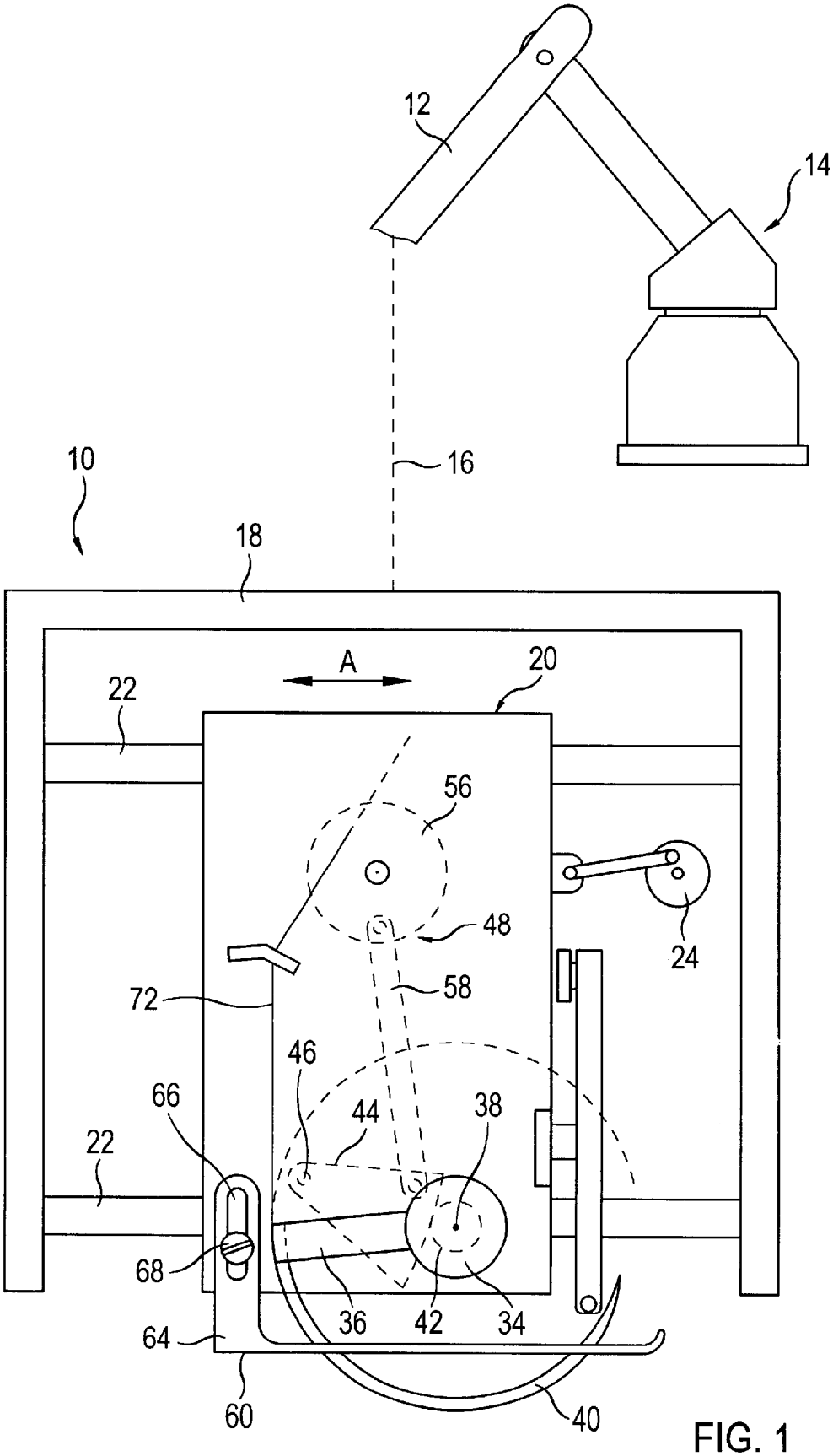
FIG. 1 a schematic partial view of a sewing head embodying the invention and looking perpendicularly to the movement path of the needle, FIG. 2 a schematic of partial side view of the catcher drive taken in a direction looking parallel the movement path of the needle, FIG. 3 a schematic representation of a sewn seam in a workpiece created by the sewing apparatus of FIGS. 1 and 2, FIG. 4 a partial schematic side view of a sewing head comprising a special embodiment of the invention and taken in the direction looking parallel to the movement path of the needle, and FIG. 5 a partially schematic perspective illustration of a modified embodiment of the sewing head illustrated in FIG. 4.

FIG. 1 shows a sewing head, indicated at 10, which is fastened to an arm 12 of a robot 14, as is indicated by the dashed line 16. By way of the robot 14 the sewing head can be moved over the desired shaped surface of the goods to be sewn.

The sewing head has a frame 18 in which a frame shaped carrier 20 (see also FIG. 2) can be moved back and forth in the direction of the double arrow A on guide 22. The movement can for example be accomplished by an eccentric drive 24, as indicated schematically in FIG. 1. The purpose of this movement will be explained later.

Figure 2:
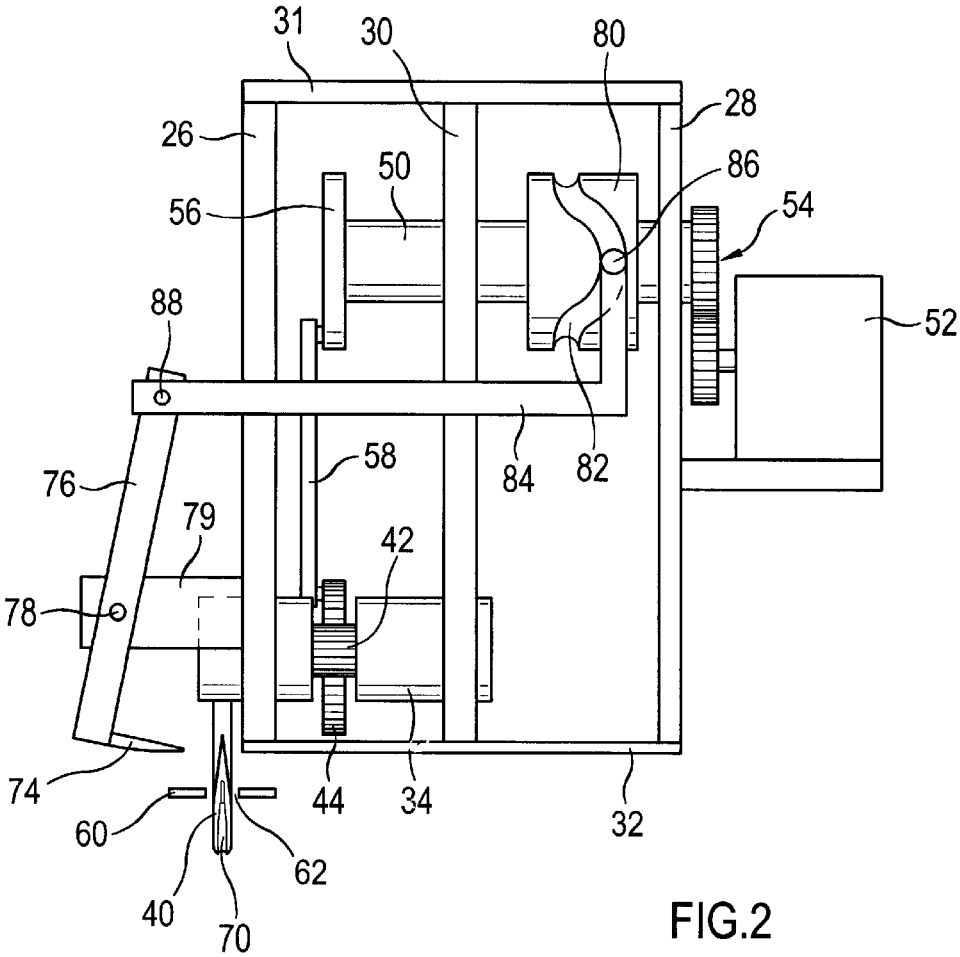

According to FIG. 2 the carrier includes a forward wall 26, a rear wall 28 and an intermediate wall 30, which are connected with one another by upper and lower cross members 31 and 32. A needle shaft 34 is rotatably supported in the lower section of the forward wall 26 and of the intermediate wall 30. A radially outwardly extending needle holder 36 is connected to the end of the needle shaft 34 which extends outwardly beyond the forward wall 26, which needle holder holds a curved needle 40 which extends around the axis 38 of the needle shaft 34 in a circular arc shape.

A middle section 42 of the needle shaft 34 is formed as a gear wheel which meshes with a toothed segment 44. The toothed segment 44 is pivotally supported in a non-illustrated way on the carrier 20 for movement about an axis 46 and can be oscillated by an eccentric drive 48 back and forth about the pivot axis 46. The eccentric drive 48 includes and eccentric shaft 50 which is rotatably supported in the intermediate wall 30 and rear wall 28 of the carrier 20 and can be continuously rotated through a drive 54 by a motor 52 fastened to the carrier 20. At the end of the eccentric shaft 50 opposite from the drive 54 is an eccentric disk 56 which is linkedly connected with the toothed segment 44 by a connecting rod 58. A continuous rotation of the eccentric shaft 50 by way of the eccentric drive of 48, the toothed segment 44 and the needle shaft 34 therefore effects a back and forth movement of the arcuate needle 40 about the axis 38 of the needle shaft 34.

At the lower end of the carrier 20 is arranged a holddown foot 64 for the goods to be sewn, which foot has the form of an elongated plate in which a slot 62 is formed (FIG. 2) into which the arcuate needle 40 can dive as seen in FIGS. 1 and 2. The plate of the holddown foot 60 is connected with an extension 64 having an elongated hole 66 receiving a screw 68 which fastens the holddown foot 62 to the carrier 20. By way of a height adjustment of the holddown foot 60 relative the carrier 20 the penetration depth of the arcuate needle 40 into the material to be sewn can be varied.

The arcuate needle has on its curved outer side a groove 70 (FIG. 2), in which the thread 72 is guided to the eye lying at the point of the needle.

The arcuate needle 40 is associated with a thread or loop catcher 74. This catcher has the form of a spike or thorn and is fastened to the lower end of a pivoting lever 76 which is so pivotally supported for movement about axis 78 of a holder 79 connected to the forward wall 26 that the loop catcher 74 can move in a pivotal plane oriented perpendicular to the movement path or movement plane of the arcuate needle 40. As shown in FIG. 1, the loop catcher 74 moves to and closely past the concave inner side of the needle point so that it can capture a thread loop formed upon the reverse movement of the needle out of the work material.

The movement of the loop catcher is achieved by a cam control. This includes a cam disk 80, located on the eccentric shaft 50, with a control groove 82 which receives a cam follower 86 located on a transmission lever 84. The transmission lever 84 is pivotally connected at 88 with the upper end of a pivotal lever 76 carrying the loop catcher 74. The control groove 82 provides the possibility of controlling however desired the movement of the loop catcher 74 within the movement cycle of the arcuate needle 40.

Figure 3:
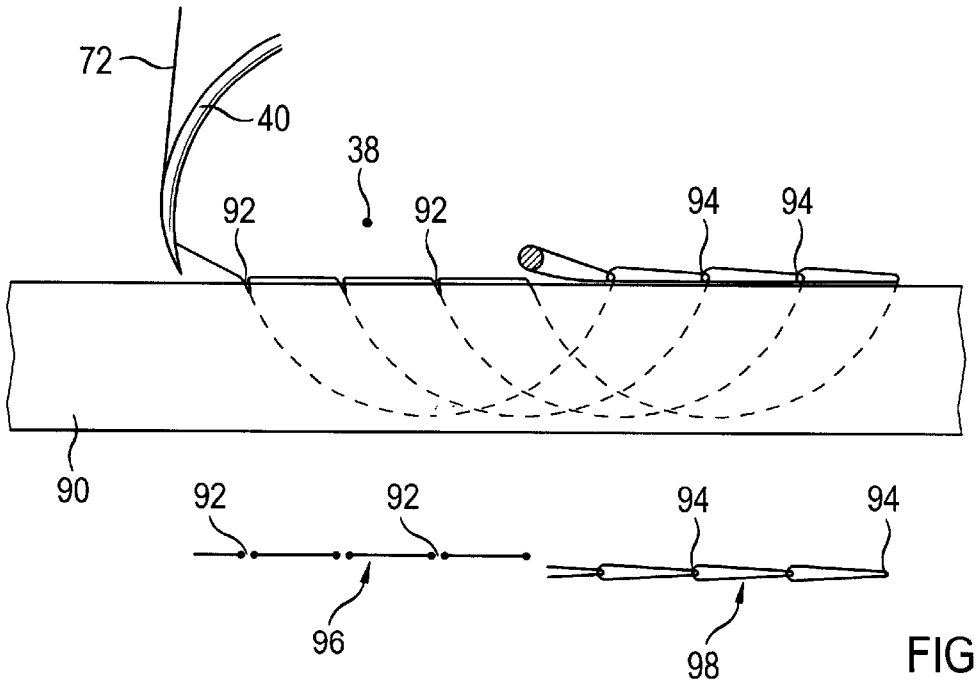

The operation of the so far described sewing device w ill be explained in connection with FIG. 3. The sewing device is there designed to sew together work material, for example fiber mats laying on an underlying support, in which case the needle may not move out of the underside of the work material. FIG. 3 shows in a schematic way the sewing process and the created form of a stitch.

The work material 90 consists, for example, of several carbon fiber mats, which in total can have a thickness of from 10 to 15mm and can have a curved upper surface. In FIG. 3 the arcuate needle is located above the work material 90. When the needle penetrates into the work material 90 it moves along the broken line path until the needle point again comes out of the upper side of the work material 90. The entrances and exits of the needle are shown respectively at 92 and 94. Upon reverse movement of the needle a small thread loop is formed in the region of the needle point, into which the thorn shaped loop catcher 74 becomes inserted and prevents the thread during the reverse movement of the arcuate needle 40 from again moving with the needle. When the arcuate needle 40 is entirely withdrawn from the work material 90 the entire carrier 20 is moved by a stretch corresponding to a stitch length in the direction of the desired course of sewing, during which the loop catcher 74 still remains in the loop and takes with it the loop, as is shown in FIG. 3. The loop catcher 74 holds the loop open until the arcuate needle 40 in the formation of the next stitch moves through the held open loop. Then the loop catcher 74 is withdrawn and catches immediately again the newly formed loop. In this way a single thread chain stitch is formed. The thread runs inside of the work material 90 along the indicated dashed lines. On the upper side of the work material 90 two seams are formed, of which one seam 96 connects together the in going stitch points 92, while the other seam 98 made up of the loops extends along the outgoing stitch points 94. If the movement path of the needle 40 is exactly parallel to the movement path of the sewing head relative to the work material 90, the seams 96 and 98 lie above one another. To avoid this, the movement plane of the needle 90 can be slightly inclined with respect to the movement direction of the sewing head, so that the two seams 96 and 98 run parallel but next to one another, as shown in FIG. 3.

While the carrier 20, along with needle 40 and loop catcher 74, advances in stepwise fashion the robot arm 12 carrying the sewing head 40 can be moved continuously relative to the work material, since the carrier 20 is slideably guided on the frame 18. Therefore, the robot arm 12 with its relatively large mass need not be constantly braked and newly accelerated.

Figure 4:
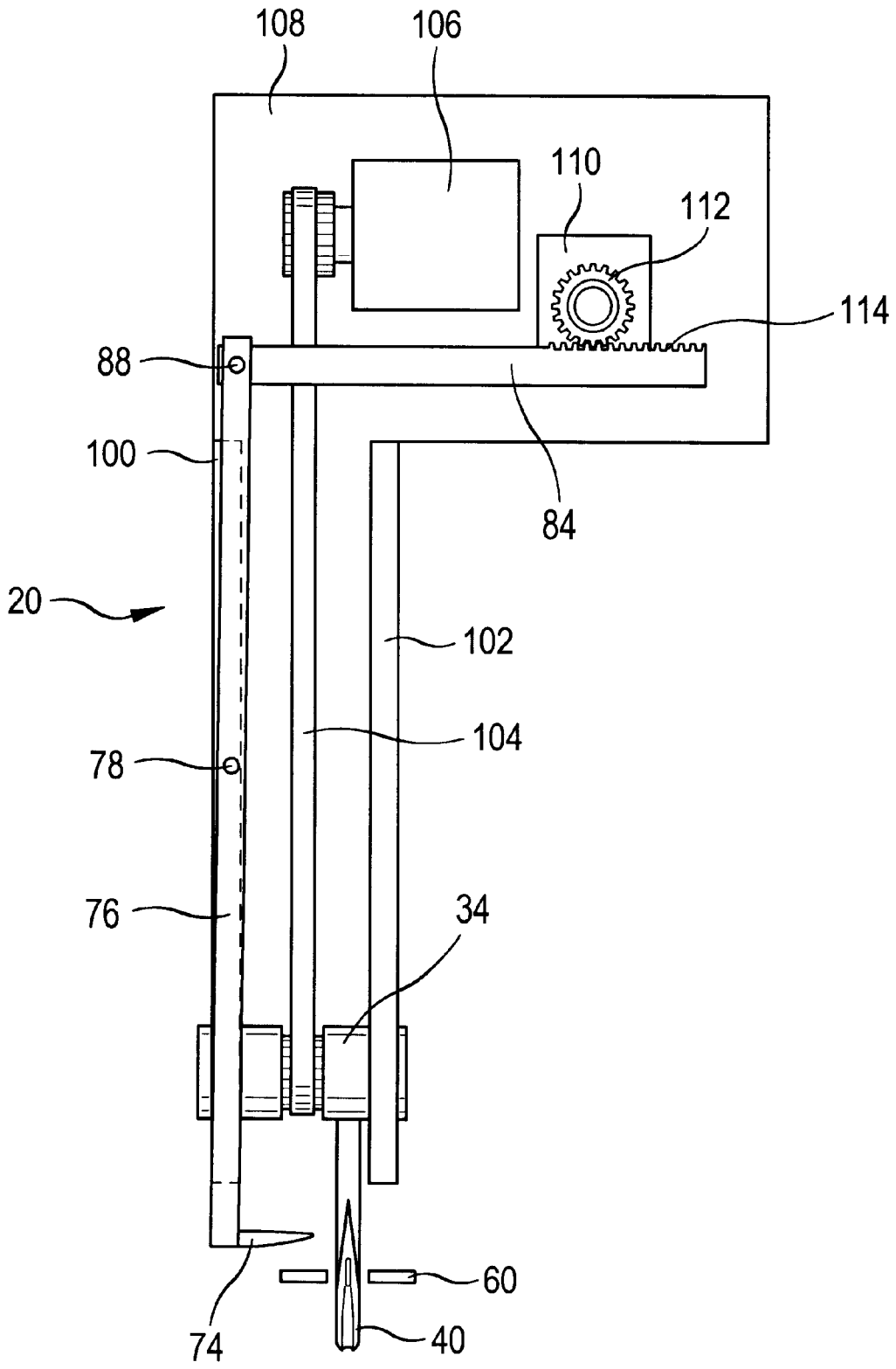

FIG. 4 shows in schematic way an embodiment especially well suited for sewing in narrow hollow spaces or for example for the sewing on of small pieces to a flat work material. In this case the needle 40 carrying part of the carrier is made very small. The needle shaft 34 is supported near the lower edges of two parallel plates 100, 102 of the carrier 20. It is driven by a motor 106 through toothed belt 104, which motor is located in the upper housing portion 108 of the carrier. The motor 106 is reversible in regard to its direction of rotation and is for example a stepping motor. Also the loop catcher 74 in this embodiment is not driven by a cam control but is driven by a reversible direction motor 110, which can move the loop catcher 74 carrying pivotal lever 76 back and forth through a pinion 112 and rack 114.

Figure 5:
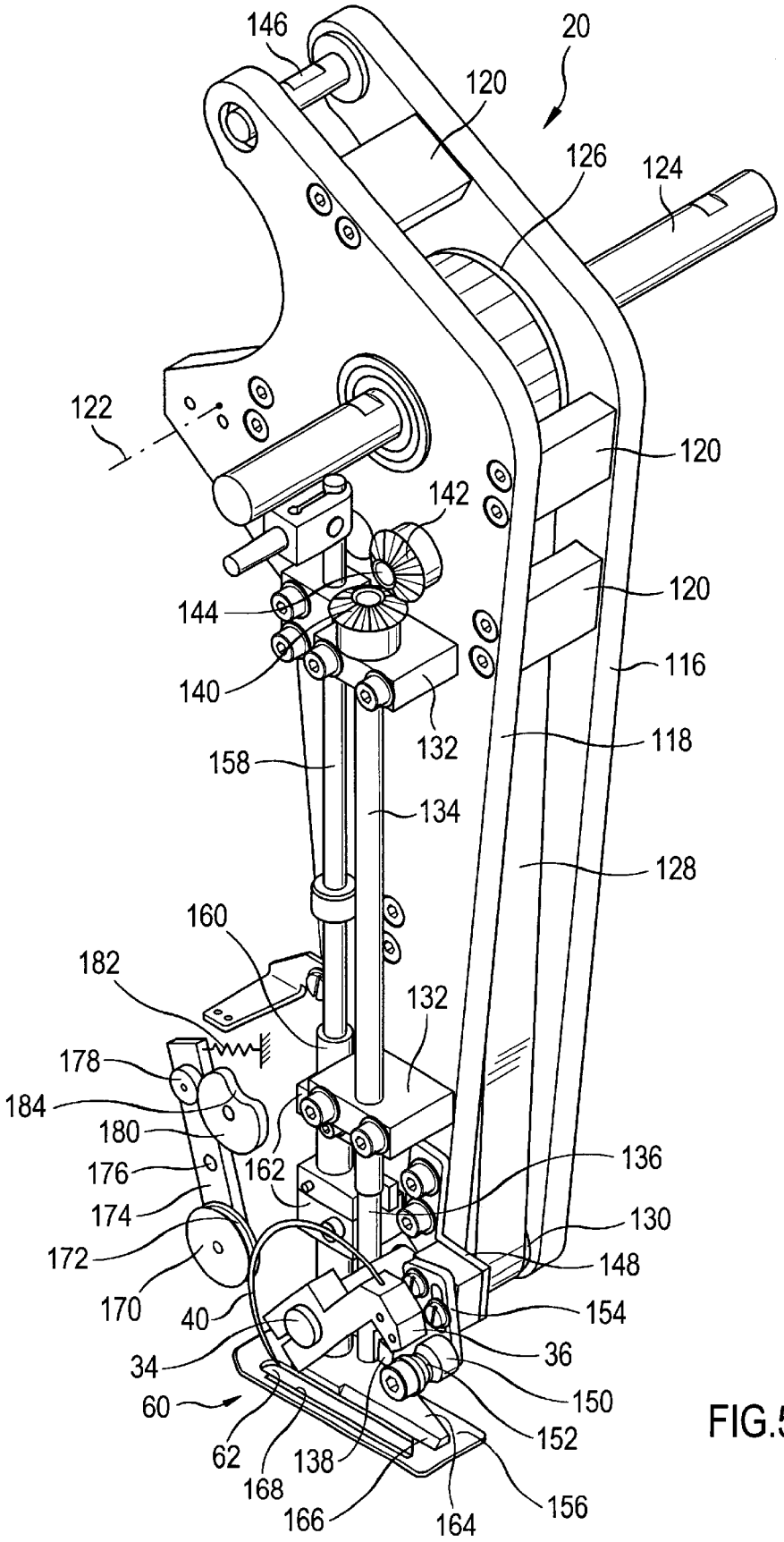

FIG. 5 shows a modified embodiment of the solution schematically illustrated in FIG. 4. In this case similar parts are again provided with similar reference numbers. The carrier 20 is formed of two elongated plates 116, 118, which are arranged parallel to one another and which are connected with one another by spacer elements 120. The entire carrier 20 is pivotally supported on a non-illustrated housing of the sewing head for movement about an axis 122. In the upper portions of the two plates 116, 118 the carrier 20 is passed through by a drive shaft 124 on which, between the two plates 116, 118, is a toothed drive wheel 126. This drive wheel 126 is connected by a toothed belt 126 with another toothed wheel 130, rotationally fixed to the needle shaft 34, which passes through the two plates 116 and 118 near the lower end of the carrier 20. The needle shaft 34 carries, as in the previously described exemplary embodiments, the needle holder 36 with the arcuate needle 40.

Fastened to the outer side of the plate 118 are two support brackets 132, in which a tube shaped guide 134 is held, which has passing through it a loop catcher shaft 136. The loop catcher shaft 136 carries at its lower end a loop catcher 138. At its upper end the loop shaft 136 is connected with a bevel gear 140 which meshes with a further bevel gear 142, arranged on a shaft 144 passing through plates 116 and 118 in a non-illustrated way.

The pivotal movement of the arcuate needle 40 about the rotational axis of the needle shaft 34, as well the pivotal movement of the loop catcher 138 about the axis of the loop catcher shaft 136, is effected by a non-illustrated eccentric drive and a cam control which are located on a likewise non-illustrated sewing head shaft. On this sewing head shaft is further arranged another eccentric drive which holds on to a shaft 146 connecting the two plates 116 and 118 at their upper ends and thereby swings the carrier 20 in its entirety back and forth about the axis 122 in order to make possible the so called needle transport. This guarantees that the carrier 120 remains at rest relative to the work material so long as the arcuate needle is received in the work material, even though the sewing head in its entirety is continuously moved relative to the work material. One such needle transport is known in itself from customary sewing machines and need not be explained in more detail.

A guide roll 150 is further supported on the outer side of the plate 118 by a lever 148, with the guide roll 150 having a circumferential groove 152. The position of the guide roll 150 can be so adjusted by means of an adjustment plate 154 on the lever 148 that the point of the arcuate needle 40 after the complete penetration of the work material, that is, when the point of the needle again escapes upwardly out of the work material, enters into the circumferential groove 152. The needle 40 is laterally guided in the area near its point by the walls of the groove and therefore can not deflect, if the loop catcher 138 is pivoted, so that it can capture the loop formed at the tip of the needle upon reverse movement of the needle.

The work material holddown indicated generally at 60 includes a plate shaped sewing foot 156 having an elongated slot 162 for the arcuate needle 40. The plate shaped sewing foot 156 is fastened to a pivot shaft 158, supported in a guide tube 160, which is held with the help of brackets 162 to the outer side of the plate 118. At the lower end of the guide tube 160 is fastened a thread cutting blade 164 which extends parallel to the upper surface of the sewing foot 156. The cutting edge 166 of the thread cutting blade 164 cooperates with a longitudinal edge 168 of the slot 62 in the sewing foot 156 which is likewise formed as a cutting edge, to cut a thread running through the slot 62. To produce the cutting effect the sewing foot 156 can be rotated about its axis by the shaft 158 so that the cutting edges 166 and 168 slide over one another. The pivot drive for the rotational movement of the sewing foot is connected to the upper end of the shaft 56 and is here not illustrated in more detail.

In the sewing of very firm and tenacious materials such as for example carbon fiber mats the needle experiences a high resistance during its insertion into the material. Since the needle 40 is of arcuate shape and the needle holder at the opposite end of the needle from the point pushes the needle, because of the resistance at its point the needle compresses and deforms in the direction of becoming an ellipse. With high sewing speeds the needle very quickly becomes destroyed through its constant deformation. To inhibit this, a support roll 170 lies at the convex outer side of the arcuate needle 40 and has a circumferential groove 172 into which the arcuate needle 40 can partially dive. The support roller 170 is supported on a two-armed pivotal lever 174 which is moveable about a pivot axis 176 and carries a cam follower roll 178 on its end opposite to the support roll 170. The cam follower roll 178 runs on a cam disk 180 against which it is biased by a spring 182. The cam disk 180 has a recess 184 which assures the support roller 170 is itself displaced from the path of the arcuate needle 140 when the needle holder 36 runs past the support roll 170. At this moment the support roll is not necessary since the needle 40 has already penetrated to a large extent into the work material and a bending of the needle can no longer take place. By means of this arrangement the life of the arcuate needle can be substantially increased.

The previously described thread cutter, the support mechanism for supporting the needle against a deflection, and as well as the guide mechanism for the needle point can understandably also be provided in the cases of the other described exemplary embodiments. They are not limited to application to the exemplary embodiment of FIG. 5.

What is claimed is:

1. A blind stitch sewing mechanism comprising:

a sewing head (10) with a carrier (20), a needle shaft (34) rotatably supported by the carrier (20), the needle shaft being connected with a needle holder (36) extending radially from the needle shaft for holding an arc shaped needle (40) curved about the axis (38) of the needle shaft (34), a needle drive (52, 54, 56, 58, 44, 42) for moving the needle (40) back and forth, a loop catcher (74) movably supported on carrier (20) for receiving a thread loop formed upon the withdrawal of the needle (40) from a workpiece (90), a catcher drive (52, 54, 80, 84) for moving the loop catcher (74) in timewise coordination with the movement of the needle (40), means (14) for creating relative movement between the sewing head (10) and the work material (90), the loop catcher (74) being supported for back and forth movement perpendicular to the movement path of the needle (40), and the means (14) for creating a relative movement between the sewing head (10) and the work material (90) being so formed that the created sewing seam runs nearly in the direction of the movement path of the arc shaped needle (40).

2. A blind stitch sewing mechanism according to claim 1, wherein:

a work material holddown (60) is arranged on a carrier (20) and has a slot (62) corresponding to the movement path of the needle (40).

3. A blind stitch sewing mechanism according to claim 2, wherein:

the work material holddown (60) is adjustable in height on the carrier (20).

4. A blind stitch sewing mechanism according to claim 1, wherein:

the loop catcher (74) is formed as a thorn which is fastened to a pivotal lever (76), which pivotal lever (76) on one hand is pivotally supported upon the carrier (20) and on the other hand is connected with the catcher drive (52, 54, 80, 84).

5. A blind stitch sewing mechanism according to claim 1, wherein:

the needle drive has a reversible drive motor (106) with an output shaft connected with the needle shaft (34) through a drive mechanism.

6. A blind stitch sewing mechanism according to claim 5, wherein:

the drive mechanism includes a toothed belt (104) which connects a toothed pulley positioned on the output shaft of the drive motor (106) and toothed pulley located on the needle shaft (34).

7. A blind stitch sewing mechanism according to claim 1, wherein:

the needle drive has a continuously rotating drive motor (52) which drives a toothed segment (44) pivotally supported on the carrier (20) through an eccentric (56, 58), which toothed segment (44) meshes with a pinion (42) arranged on the needle shaft (34).

8. A blind stitch sewing mechanism according to claim 7, wherein:

the catcher drive is controlled by a cam disk (80) located on the eccentric shaft (50).

9. A blind stitch sewing mechanism according to claim 1, wherein:

the catcher drive has a reversible drive motor.

10. A blind stitch sewing mechanism according to claim 1, wherein:

the carrier (20) is moveably supported in a frame (18) of the sewing head (10) for translatory movement of the carrier back and forth parallel to the relative movement between the sewing head (10) and work material (90).

11. A blind stitch sewing mechanism according to claim 1, wherein:

the sewing head 10 is arranged on a robot (14).

12. A blind stitch sewing mechanism according to claim 1, wherein:

a guide (105) is arranged above the work material holddown (60) for guiding an area of the needle 40 neighboring the needle point, which guide after the sticking of the needle (40 ) into the work material and until the forward end of the needle again escapes from the work material secures the needle against a lateral deflection.

13. A blind stitch sewing mechanism according to claim 12, wherein:

the guide is formed as an annular groove (152) in a roll (150).

14. A blind stitch sewing mechanism according to claim 1, wherein:

the arcuately shaped needle (40) has associated with it a needle support (170) which supports the needle(40) at its convex outer side during at least a portion of the needle stroke.

15. A blind stitch sewing mechanism according to claim 14, wherein:

the needle support has a roll (170) rotatably supported for movement about an axis parallel to the curvature axis of the needle (40) and which has a circumferential groove (172) for receiving the needle (40).

16. A blind stitch sewing mechanism according to claim 15, wherein:

the roll (170) is moveable between a supporting position in which it lies against the needle (40) and an alternate position in which it is spaced from the needle (40).

17. A blind stitch sewing mechanism according to claim 16, wherein:

the roll (170) is arranged on a pivotal lever (174) which is so coupled with the sewing machine drive that it in timewise coordination with the needle movement is pivotal between the supporting position and the alternate position of the roll (170).

18. A blind stitch sewing mechanism according to claim 1, wherein:

the work material holddown (60) has a foot plate (156) for engaging the workpiece and having a slot (62) for the needle (40) with at least one longitudinal edge of the slot being formed as a first cutting edge (168), and a counter knife with a second cutting edge (166) is arranged parallel to and above foot plate (156) with the foot plate (156) and the counter knife (164) being moveable relative to one another parallel to the upper surface of the foot plate.

19. A blind stitch sewing mechanism according to claim 18, wherein:

the foot plate (156) and the counter knife (164) are pivotal to one another about an axis perpendicular to the foot plate upper surface.

20. A blind stitch sewing mechanism according to claim 19, wherein:

the counter knife (164) or the foot plate (156) is arranged a tube (160) and the other part (foot plate (156), counter knife (164)) is fastened to a rod (158) in the tube (160) and coupled with a pivotal drive.

* * * * *